US005526851A

United States Patent [19]

Hwang et al.

[11] Patent Number: 5,526,851

[45] Date of Patent: Jun. 18, 1996

[54] VARIABLE PITCH CYCLINDRICAL CAM MECHANISM FOR CONTROLLING THE MOTION OF A WEFT INSERTION MEMBER

[75] Inventors: Wen-Miin Hwang; Hong-Sen Yan; Shiemo Liaw, all of Tainan, Taiwan

[73] Assignee: National Science Council, Taipei, Taiwan

[21] Appl. No.: 427,413

[22] Filed: Apr. 24, 1995

[51] Int. Cl.[6] ..... D03D 47/18

[52] U.S. Cl. ..... 139/449; 74/59; 74/89.15

[58] Field of Search ..... 139/449; 74/59, 74/89.15, 57, 58

[56] References Cited

U.S. PATENT DOCUMENTS

| | | | |
|---|---|---|---|
| 4,052,906 | 10/1977 | Genini | 74/57 |
| 4,535,642 | 8/1985 | Ohmura | 74/58 |
| 4,624,288 | 11/1986 | Pezzoli | 139/449 |
| 5,033,516 | 7/1991 | Debaes | 139/449 |
| 5,320,143 | 6/1994 | Hwang et al. | 139/449 |

*Primary Examiner*—Andy Falik

*Attorney, Agent, or Firm*—Hitt Chwang & Gaines

[57] ABSTRACT

An apparatus for controlling the motion of a weft insertion member in shuttleless looms, the apparatus includes: a triple-threaded variable pitch cylindrical cam, adapted to be secured to the weft insertion member; and a slider, which contains three roller seats to receive six frustoconical rollers, in which the six frustoconical rollers are divided into three groups, each group has two frustoconical rollers, each group of two frustoconical rollers is rotatably received by one roller seat and is located between two adjacent threads of the triple-threaded variable pitch cylindrical cam with different one of the two frustoconical rollers contacting different one of the two adjacent threads so that each thread of the triple-threaded variable pitch cylindrical cam is in mating engagement with two frustoconical rollers from two different groups of the three groups of two frustoconical rollers.

1 Claim, 6 Drawing Sheets

VARIABLE PITCH CYCLINDRICAL CAM MECHANISM FOR CONTROLLING THE MOTION OF A WEFT INSERTION MEMBER

FIELD OF THE INVENTION

The present invention relates to a mechanism which has a variable pitch cylindrical cam on which three pairs of frustoconical rollers are engaged, and particularly to such a mechanism for use in shuttleless looms.

BACKGROUND OF THE INVENTION

Referring to FIG. 1, the conventional weaving loom primarily comprises a warp reel 1, a harness 2, a shuttle 3, a grill or reed 4 and a cloth roll 5. Ordinarily, woven fabric is produced by combining a plurality of warp yarns and a weft in a particular relation, such as in an interlacing relation. Normally, the plurality of warp yarns are divided into upper warp yarns 6*a* and lower warp yarn 6*b*. The upper warp yarn 6*a* and the lower warp yarns 6*b* are respectively held by an upper harness 2*a* and a lower harness 2*b* such that a shed is formed between the upper warp yarns 6*a* and the lower warp yarns 6*b*. In weaving operation, a weft-carrying insertion member, which is also known as a shuttle 3 (hereinafter "shuttle"), moves back and forth through the shed in a particular motion. Whenever the shuttle 3 completes a cycle, the grill (i.e., reed) 4, which acts as a comb, beats the weft to the right side to make the woven fabric dense and then returns to the left. A weaving loom of this kind is a so-called traditional weaving loom.

By contrast, a shuttleless weaving loom uses a weft-carrying gripper instead of a shuttle, for example, in the rapier weaving loom. Referring now to FIG. 2, a schematic diagram of a shuttleless weaving loom is shown. A weft-carrying gripper 30 and a weft-drawing gripper 31 are carried by a flexible strap 33 which is wrapped around a wheel 36. The wheel 36 (for example, a belt wheel or gearwheel) is in turn driven by a driving mechanism 35. During weaving, the weft-carrying gripper 30 and weft-drawing gripper 31 move in a certain reciprocating motion, for example, in a more or less sinusoidal motion (also known as simple harmonic motion). To obtain such a motion, the driving mechanisms for the non-traditional weaving loom are mainly of three types: jet loom, gear and crank loom, and variable pitch cylindrical cam loom. Of the above three types of weaving machines, the variable pitch cylindrical cam loom is increasingly popular due to its high insertion rate of the weft end.

Genini U.S. Pat. No. 4,052,906, discloses a mechanism for controlling the motion of the weft-carrying grippers in looms. With reference to FIG. 3, the mechanism employs a cylindrical cam 29 with two pairs of cylindrical rollers 28 moving on each thread of the cam screw 29. In such a mechanism, the cylindrical rollers 28 suffer serious wear at high insertion rates. Pezzoli, U.S. Pat. No. 4,624,288, discloses a mechanism to control the movements of weft insertion members in shuttleless weaving looms as shown in FIG. 4. In such a mechanism, a rotary rectilinear motion of the gearwheel is achieved by a variable pitch cylindrical cam 44 with two pairs of sliding blocks 43 with an involute profile. The first drawback of such a mechanism is that the sliding blocks 43 are difficult to machine. The second drawback of such a mechanism is that the mating precision of the variable pitch cylindrical cam 44 and the sliding blocks 43 is relatively high. The third drawback of such a mechanism is the contact surface of the variable pitch cylindrical cam 44 and the sliding blocks 43 are worn out at high operation speeds. Eventually, the positioning accuracy of the weft-carrying gripper or the weft-drawing gripper deteriorates.

In order to overcome the above drawbacks, two of the present inventors and one co-worker in U.S. Pat. No. 5,320,143 disclose a mechanism to control the motion of a weft insertion member in a shuttleless weaving loom. With reference to FIG. 5, the mechanism comprises a framework, a variable pitch double-threaded cylindrical cam 53, two pairs of frustoconical rollers 50*a*, 50b, 50*c*, 50*d*, roller seats, and a slider. The mechanism is characterized in that during the rectilinear reciprocating motion of the weft-carrying gripper or the weft-drawing gripper caused by the rotary reciprocating motion of the variable pitch double-threaded cylindrical cam, the conjugate relation between the thread of the variable pitch cylindrical cam and said two pairs of frustoconical rollers is maintained at all times. Moreover, the plane containing the axes of each pair of frustoconical rollers is inclined at such an angle to the plane perpendicular to the axis of the cylindrical cam that the thickness of each thread of the cylindrical cam is almost constant and hence the strength of each thread of the cylindrical cam is also uniform. The cylindrical cam of this '143 invention has two opposite threads. Each pair of the frustoconical rollers are forced to be in immediate contact with each thread by a preload. Under the predetermined loading, any backlash that may exist between the cylindrical cam and these frustoconical rollers is thus eliminated. However, since the load acting on the slider is shared by four frustoconical rollers, the wear and fatigue of the contact surfaces of these frustoconical rollers and the cylindrical cam is still not insignificant at high operation speeds, and thus can be further improved.

SUMMARY OF THE INVENTION

The primary objective of the present invention is to provide an improved mechanism to control the motion of a weft insertion member in a shuttleless weaving loom, which has a relatively long operation life.

In order to accomplish this objective, an improved mechanism to control the motion of a weft insertion member in shuttleless looms constructed in accordance with the present invention comprises:

a multiple-threaded variable pitch cylindrical cam, which is adapted to be secured to the weft insertion member, and.

a slider, which has a plurality pairs of frustoconical rollers by which the slider is drivingly engaged to the multiple-threaded variable pitch cylindrical cam with each pair of the frustoconical rollers engaged to each thread of the multiple-threaded variable pitch cylindrical cam, each roller having an angle of inclination formed such that the profile of each thread of the variable cylindrical cam is in a conjugate relation with the surface of each pair of the frustoconical rollers to obtain smooth transmission from rectilinear reciprocating motion of the slider to rotary reciprocating motion of the variable pitch cylindrical cam, wherein the improvement comprises said multiple-threaded variable pitch cylindrical cam being a triple-threaded variable pitch cylindrical cam, said a plurality pairs of frustoconical rollers being three pairs of frustoconical rollers, and three roller seats adapted to receive six frustoconical rollers of said three pairs of frustoconical rollers being mounted on the slider, in which said six frustoconical rollers are divided into three groups, each group has two frustoconical rollers, each group of two frustoconical rollers is rotatably received by one roller seat and is located between two adjacent threads of said triple-threaded variable pitch cylindrical cam with different one of the two frustoconical rollers contacting different one of the two adjacent threads so that said three pairs of frustoconical rollers are formed with each pair of frustoconical rollers constituted by two frustoconical rollers from two different groups of said three groups of two frustoconical rollers.

Preferably, the present mechanism further comprises three needle bearings for connecting said three roller seats to the slider, said needle bearings providing a rotary degree of freedom between the roller seats and the slider such that one of the two frustoconical rollers received by the roller seat will intimately contact one thread of said two adjacent threads when the other one of the two frustoconical rollers received by the same roller seat is forced to drivingly engage to the other one thread of said two adjacent threads of said triple-threaded variable pitch cylindrical cam, whereby the frustoconical rollers will be in immediate contact with the threads at the moment when the motion of the slider is reversed, and any backlash that may exist between the cylindrical cam and the frustoconical rollers in the reciprocating motion of the slider is thus eliminated.

Since the load acting on the slider is shared by 1.5 times of the number of frustoconical rollers used in the prior art mechanism, the wear and fatigue of the contact surfaces of these frustoconical rollers and the cylindrical cam is lessened in the present mechanism, and the operation life of the frustoconical rollers and the cylindrical cam is thus extended.

BRIEF DESCRIPTION OF THE DRAWINGS

Other objectives and advantages of the present invention will become clear from the following description with reference to the accompanying drawings, wherein.

DETAILED DESCRIPTION OF THE INVENTION

The present invention is an improvement to the mechanism for controlling the motion of a weft insertion member in a shuttleless weaving loom disclosed in U.S. Pat. No. 5,320,143, the disclosure of which is incorporated herein by reference.

Figure 1:
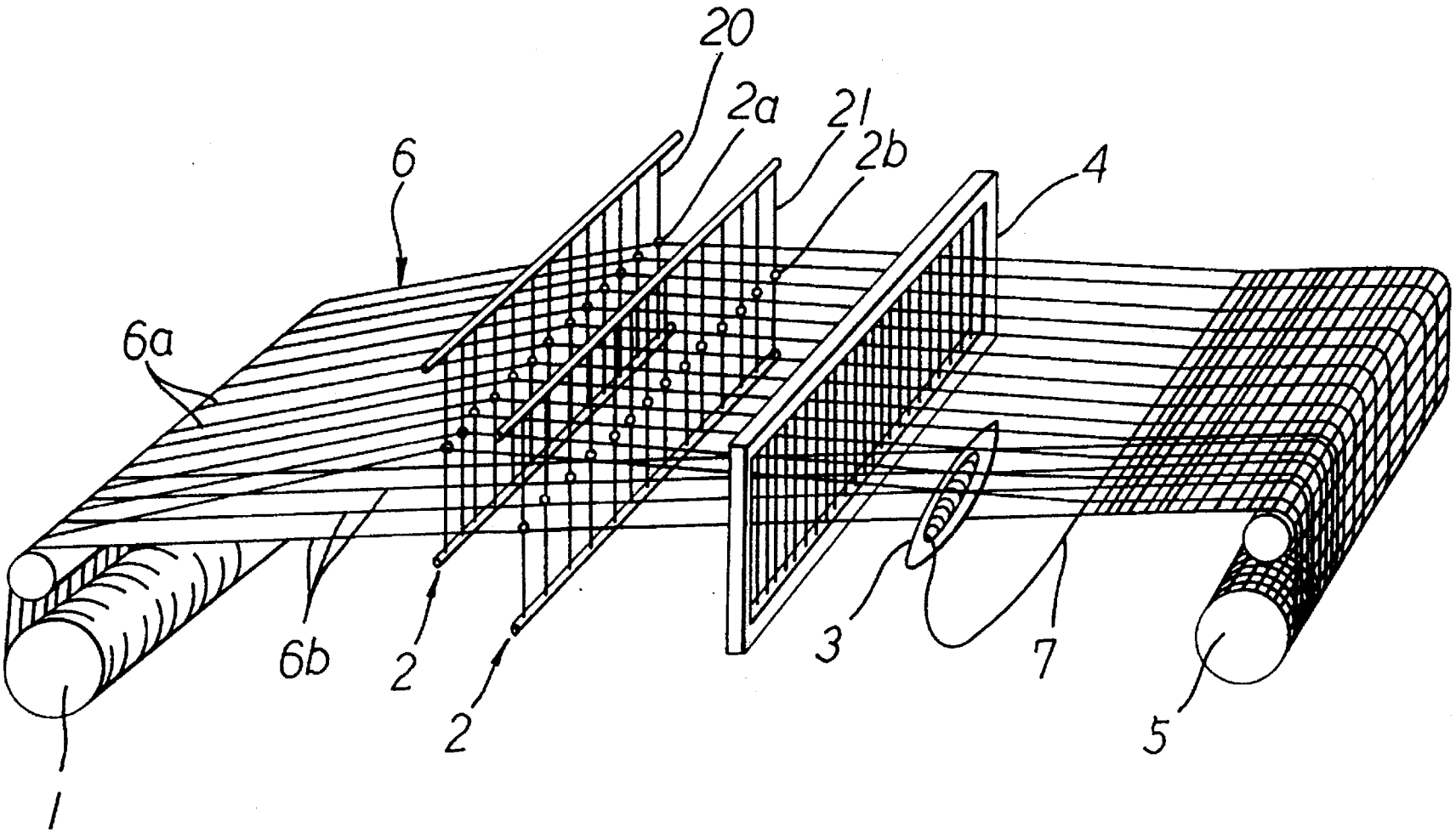
FIG. 1 is a schematic view of a traditional weaving loom with shuttle.
Figure 2:
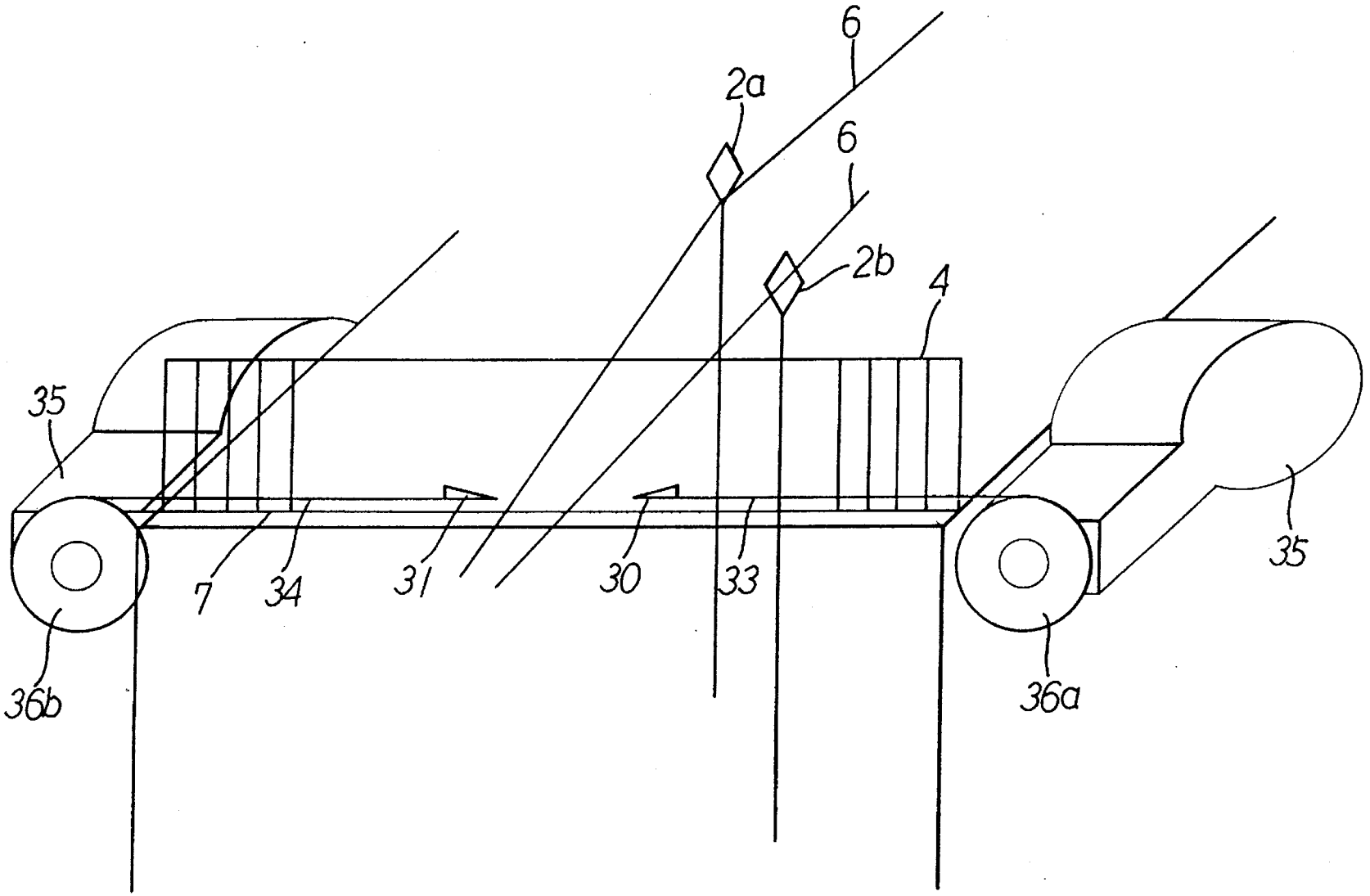
FIG. 2 is a schematic view of a rapier weaving loom.
Figure 3:
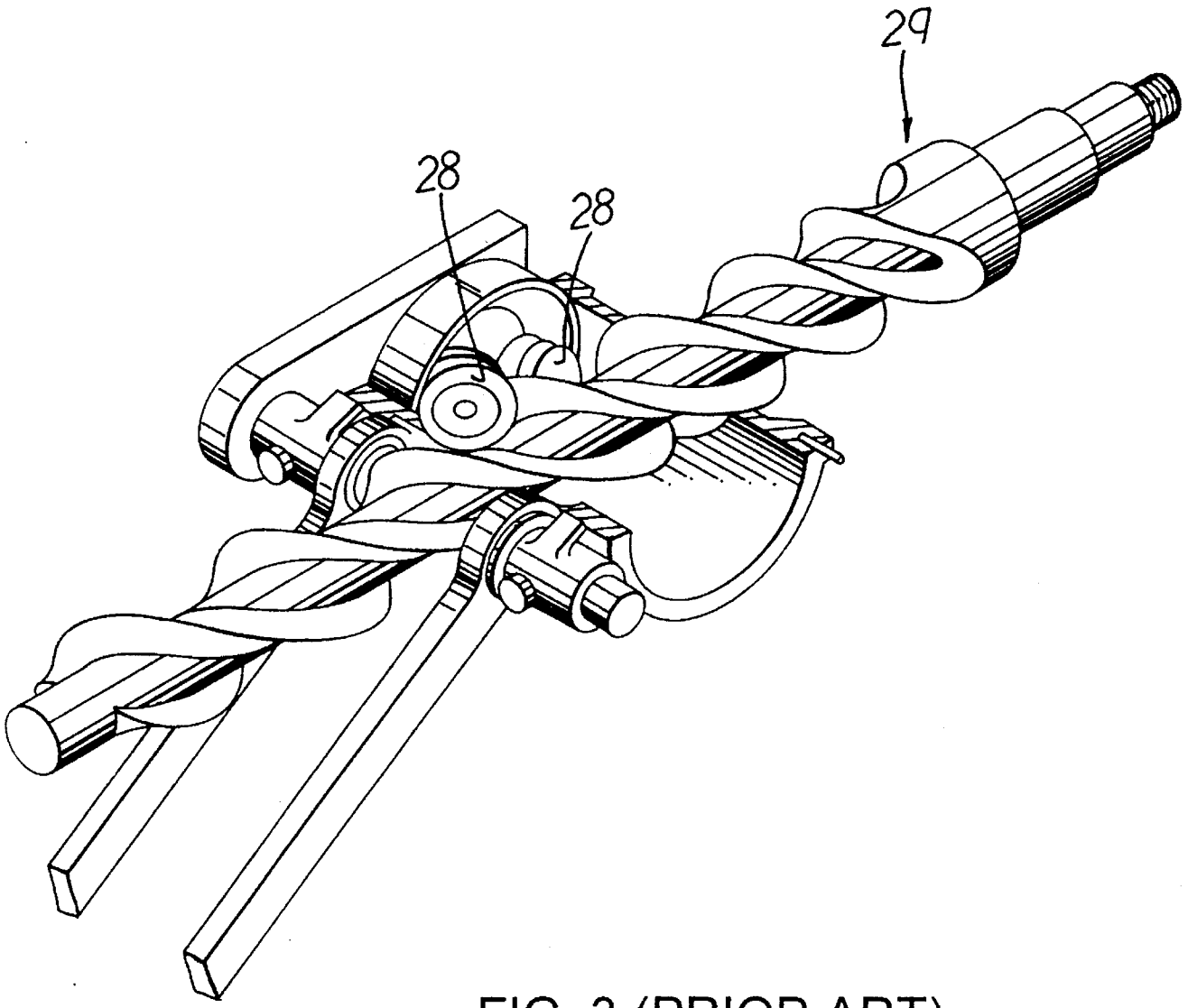
FIG. 3 (PRIOR ART)
FIG. 3 is a schematic view of the conventional mechanism for controlling the motion of the weft carrying grippers in looms.
Figure 4:
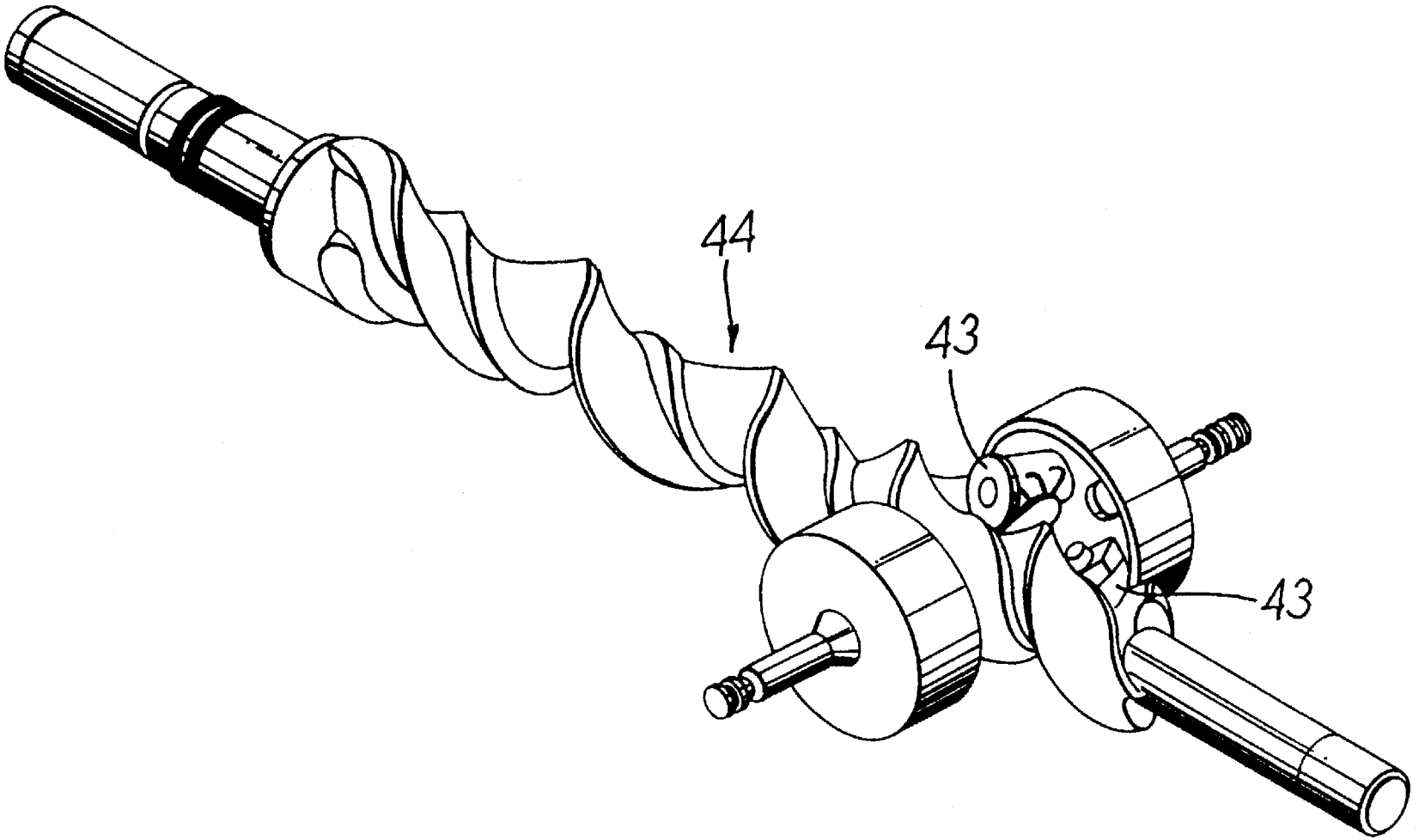
FIG. 4 (PRIOR ART)
FIG. 4 is a schematic view of the conventional mechanism to control the movements of weft insertion members in shuttleless weaving looms.
Figure 5:
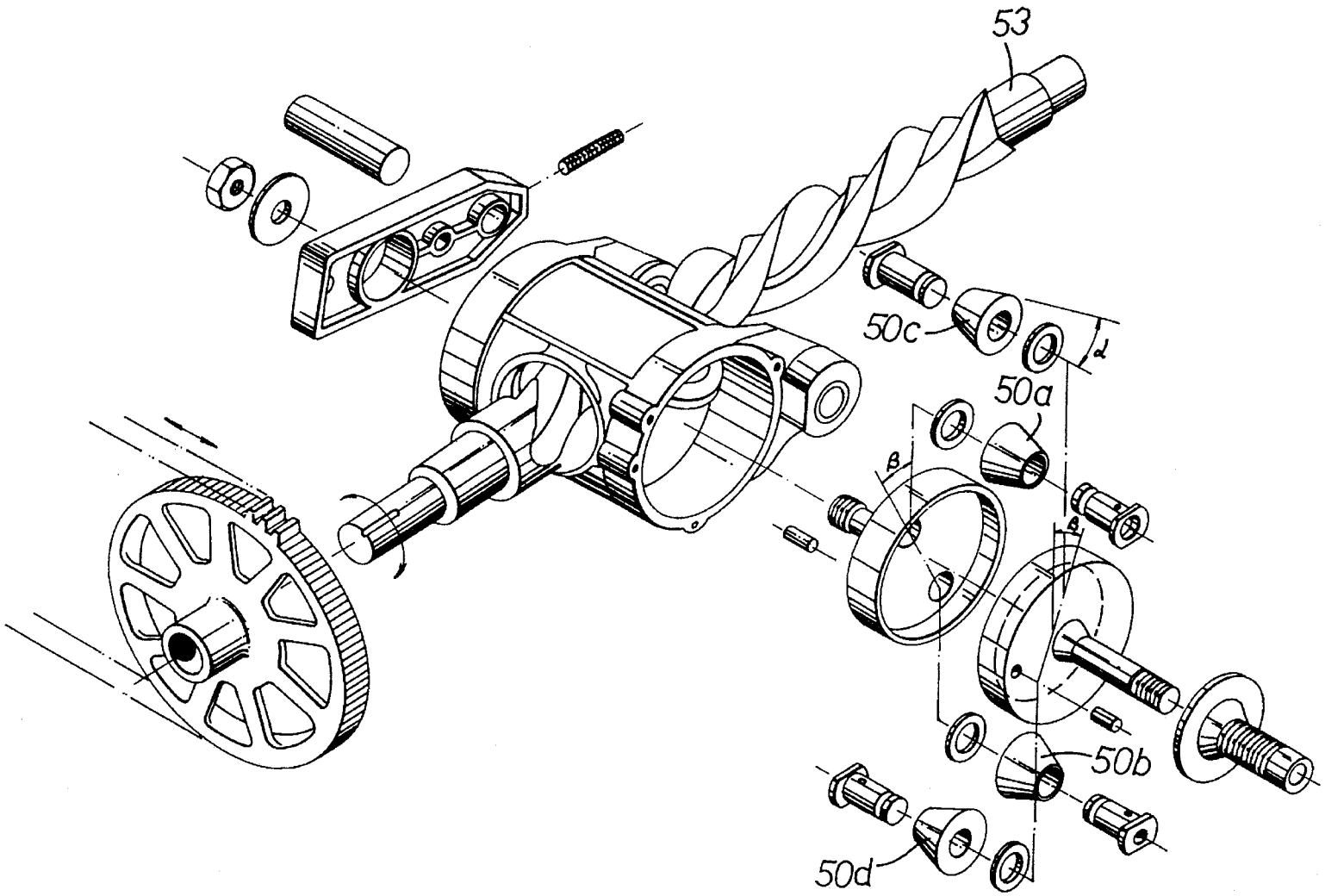
FIG. 5 (PRIOR ART)
FIG. 5 is a schematic view of the conventional mechanism to control the movements of weft insertion members in shuttleless weaving looms.
Figure 6:
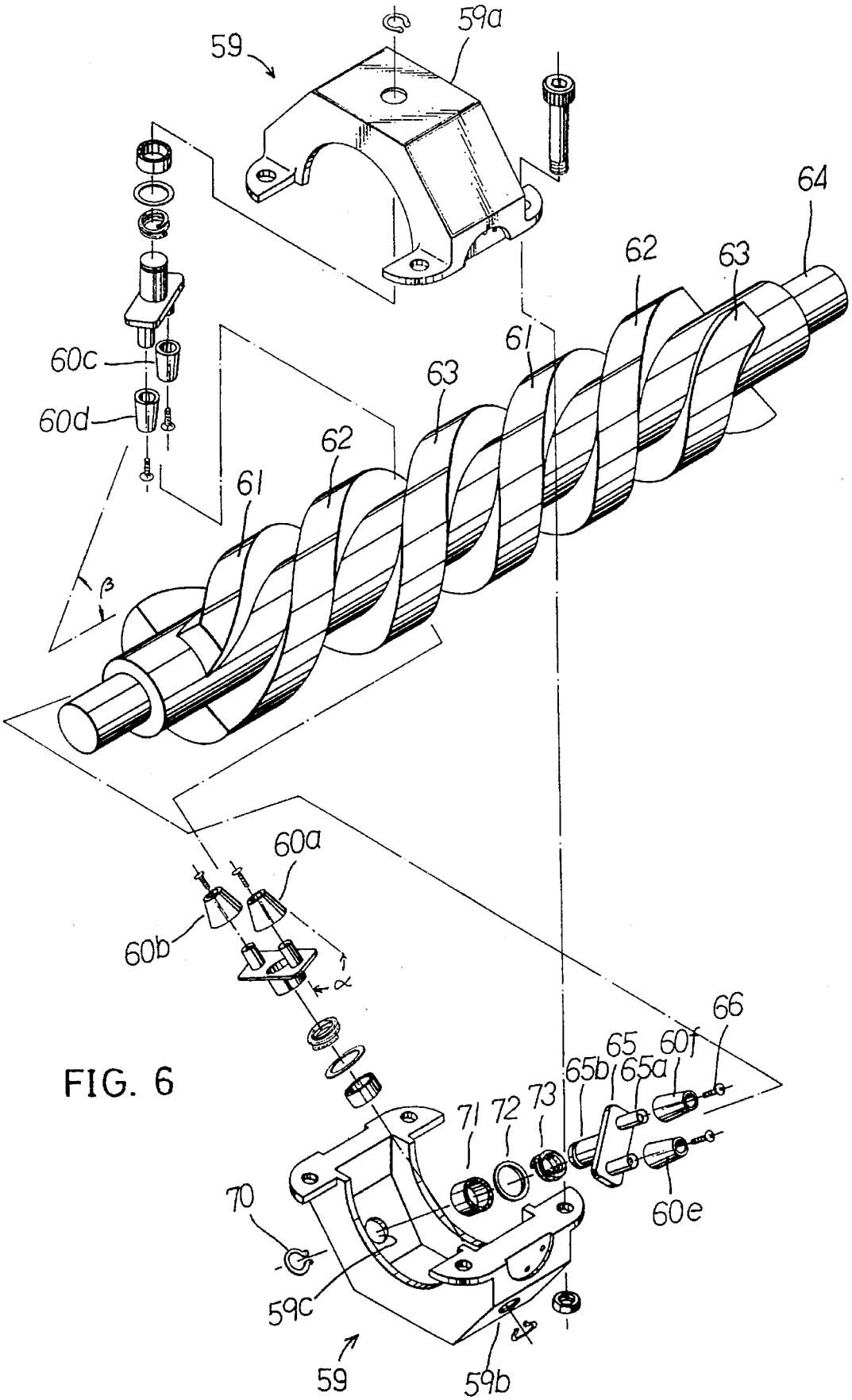
FIG. 6 is a schematic view of the mechanism for controlling the motion of the weft insertion in a shuttleless loom according to the present invention.

With reference to FIG. 6, the weft insertion is mainly performed by six frustoconical rollers 60*a*, 60*b*, 60*c*, 60*d*, 60*e* and 60*f* which are rotatably mounted in a slider 59, and by a variable pitch triple-threaded cylindrical cam 64 having three different threads 61, 62 and 63. The slider 59 is composed of two generally C-shaped brackets 59*a* and 59*b* which are fastened securely to each other by four screws at four corners thereof. The slider 59 has a central circular hole created by the two brackets 59*a* and 59*b*, through which the slider moves in rectilinear reciprocating motion along the axis of the cylindrical cam 64 with the frustoconical rollers 60*a*–60*f* mounted therein being in strictly mating engagement with the threads 61–63 of the cylindrical cam 64.

The six frustoconical rollers 60*a*–60*f* are divided into three groups: 60*a* and 60*b*; 60*c* and 60*d*; and 60*e* and 60*f*, each group of which is rotatably mounted in the slider in the same manner. In the following, one group of the frustoconical rollers, namely 60*e* and 60*f*, is used as an example to show how the three groups of frustoconical rollers are mounted in the slider. The frustoconical rollers 60*e* and 60*f* both have a bore formed in the center and a semi-conical angle α, which are rotatably received by a roller seat 65 by passing two hollow posts 65*a* provided at one side of the roller seat 65 through the bores of the frustoconical rollers 60*e*, 60*f*, and by threading two screws 66 into two threaded holes provided at the ends of the two hollow posts 65*a*. An upright cylindrical rod 65*b* is provided at another side of the roller seat 65, a compression spring 73, washer 72 and needle bearing 71 are received by the cylindrical rod 65*b* in sequence prior to the cylindrical rod 65*b* passing through a corresponding circular aperture 59*c* formed in the C-shaped bracket 59*b*. An elastic retaining ring 70 is then fastened to a groove provided round the protruding end of the cylindrical rod 65*b*. Upon assembly of these elements, not only the frustoconical rollers 60*e* and 60*f* are rotatably received by the roller seat 65, but a rotary degree of freedom between the roller seat 65 and the slider is created by the use of the needle bearing 71.

Each group of the frustoconical rollers is located between two adjacent threads of the cylindrical cam 64, wherein the frustoconical rollers 60*a* and 60*b* are placed between the threads 61 and 63, in which the frustoconical roller 60*a* contact the right side of the thread 63, and the frustoconical roller 60*b* contact the left side of the thread 61; the frustoconical rollers 60*c* and 60*d* are placed between the threads 63 and 62, in which the frustoconical roller 60*c* contact the right side of the thread 62, and the frustoconical roller 60*d* contact the left side of the thread 63; and the frustoconical rollers 60*e* and 60*f* are placed between the threads 61 and 62, in which the frustoconical roller 60*e* contact the right side of the thread 61, and the frustoconical roller 60*f* contact the left side of the thread 62. Please note that the contact positions of frustoconical rollers 60*e* and 60*f* to the threads 61 and 62 are observed in a front view of the cylindrical cam 64 shown in FIG. 6 and by imagining the cylindrical cam 64 being transparent. In this arrangement, each thread of the cylindrical cam 64 is in strictly mating engagement with two frustoconical rollers from two different groups of frustoconical rollers by a compression spring 73. For example, thread 63 is in engagement with the frustoconical rollers 60*d* and 60*a* which contact the left side and right side of the thread 63 respectively. The imaginary plane defined by the rotary axes of each group of frustoconical rollers is inclined at an angle 13 with the rotary axis of the cylindrical cam 64. This angle will vary along the helix angle of the threads of the variable pitch cylindrical cam 64. As long as a driving force is transmitted to the slider, the slider will move in a rectilinear reciprocating motion along the axis of the variable pitch cylindrical cam 64. Subsequently, the variable pitch cylindrical cam 64 is forced to rotate in a reciprocating manner along its axis by the frustoconical rollers 60*b*, 60*d* and 60*f* in one direction and by the frustoconical rollers 60*a*, 60*c* and 60*e* in the opposite direction. In this manner, a gearwheel (not shown) is rotated forwards and backwards. Eventually, the rectilinear reciprocating motion of a weft-carrying gripper or a weft-drawing gripper ,connected to the gearwheel is obtained.

In the present invention, the needle bearing 71 provides a rotary degree of freedom between the roller seat and the slider such that one of the two frustoconical rollers received by the roller seat will intimately contact one thread of said two adjacent threads when the other frustoconical roller is forced to drivingly engage to the other thread of said two adjacent threads, whereby the frustoconical rollers will be in immediate contact with the threads of the cylindrical cam at the moment when the motion of the slider is reversed, and impact of the frustoconical rollers to the threads can thus be eliminated. Moreover, the wear and fatigue of the contact surface of the frustoconical rollers and the cylindrical cam is lessened in the present mechanism, because the load acting on the slider is shared by six frustoconical rollers. The shape of the frustoconical roller with semi-conical angle $\alpha$ (for example 3° or 5°) is simple and is easy to manufacture. According to the principles of the present invention, the imaginary plane defined by the rotary axes of each group of frustoconical rollers is inclined at an angle $\beta$ with the rotary axis of the cylindrical cam 64. The thread profile of the cylindrical cam is generated by mating the profile of the frustoconical rollers based on a conjugate relation. Therefore, the contact between the frustoconical rollers and the cylindrical cam is smooth. In particular, the uniform thickness of the threads of the cylindrical cam is obtained by voluntarily adjusting the angle $\beta$ along the helix angle of the threads of the variable pitch cylindrical cam. Consequently, the strength of the threads of the variable pitch cylindrical cam is increased.

What is claimed is:

1. An apparatus for controlling the motion of a weft insertion member in a shuttleless loom comprising:

a multiple-threaded variable pitch cylindrical cam, adapted to be secured to the weft insertion member, said multiple-threaded variable pitch cylindrical cam being a triple-threaded variable pitch cylindrical cam;

a slider having a plurality pairs of frustoconical rollers by which said slider is drivingly engaged to said multiple-threaded variable pitch cylindrical cam with each pair of said frustoconical rollers engaged to each thread of said multiple-threaded variable pitch cylindrical cam, each roller having an angle of inclination formed whereby the profile of each thread of said variable cylindrical cam is in a conjugate relation with the surface of each pair of said frustoconical rollers to obtain smooth transmission from rectilinear reciprocating motion of said slider to rotary reciprocating motion of said variable pitch cylindrical cam, said plurality pairs of frustoconical rollers being three pairs of frustoconical rollers;

three roller seats adapted to receive six frustoconical rollers of said three pairs of frustoconical rollers mounted on the slider, wherein said six frustoconical rollers are divided into three groups, each group having two frustoconical rollers, and wherein each group of two frustoconical rollers is rotatably received by one roller seat and is located between two adjacent threads of said triple-threaded variable pitch cylindrical cam with a different one of the two frustoconical rollers contacting said different one of the two adjacent threads whereby said three pairs of frustoconical rollers are formed with each pair of frustoconical rollers constituted by two frustoconical rollers from two different groups of said three groups of two frustoconical rollers; and three needle bearings for connecting said three roller seats to said slider, said needle bearings providing a rotary degree of freedom between said roller seats and said slider whereby one of the two frustoconical rollers received by said roller seat will intimately contact one thread of said two adjacent threads when the other of the two frustoconical rollers received by the same roller seat is forced to drivingly engage to the other thread of said two adjacent threads of said triple-threaded variable pitch cylindrical cam, and whereby the frustoconical rollers will be in immediate contact with the threads at the moment when the motion of the slider is reversed, thereby eliminating any backlash that may exist between said cylindrical cam and said frustoconical rollers in the reciprocating motion of said slider.

* * * * *

UNITED STATES PATENT AND TRADEMARK OFFICE

CERTIFICATE OF CORRECTION

PATENT NO. : 5,526,851
DATED : June 18, 1996
INVENTOR(S) : Hwang et al.

It is certified that error appears in the above-indentified patent and that said Letters Patent is hereby corrected as shown below:

On the title page, in the title, delete "CYCLINDRICAL" and insert therefore -- CYLINDRICAL --.

On the Cover Page, in the Inventors, delete "Wen-Miin Hwang; Hong-Sen Yan; Shiemo Liaw, all of Tainan, Taiwan" and insert therefore -- Wen-Miin Hwang; Hong-Sen Yan, both of Tainan, Taiwan; Shi-Mo Liaw, Kao Hsiung, Taiwan --.

Col. 1, in the title, delete "CYCLINDRICAL" and insert therefore -- CYLINDRICAL --.

Col. 2, line 47, delete "and." and insert therefore -- and --.

Col. 4, line 58, delete "13" and insert therefore -- β --.

Col. 5, line 3, delete ",connected" and insert therefore -- connected --.

Signed and Sealed this

Tenth Day of September, 1996

Bruce Lehman

*Attest:*

BRUCE LEHMAN

*Attesting Officer*

*Commissioner of Patents and Trademarks*